US006022427A

United States Patent [19]

Wienand et al.

[11] Patent Number: 6,022,427

[45] Date of Patent: Feb. 8, 2000

[54] METHOD FOR PRODUCING HELICAL SPRINGS

[75] Inventors: Josef Wienand, Werdohl; Gerhard Mier, Hagen, both of Germany

[73] Assignees: Fried Krupp, AG Essen; Hoesch-Krupp, Dortmund, both of Germany

[21] Appl. No.: 09/126,059

[22] Filed: Jul. 20, 1998

[30] Foreign Application Priority Data

Feb. 8, 1997 [DE] Germany ..... 197 33 529

[51] Int. Cl.[7] ..... C21D 9/02

[52] U.S. Cl. ..... 148/580; 148/908; 72/53; 72/76

[58] Field of Search ..... 148/580, 908; 72/53, 76

[56] References Cited

U.S. PATENT DOCUMENTS 5,665,179 9/1997 Izawa et al. ..... 148/226

5,816,088 10/1998 Yamada et al. ..... 75/53

FOREIGN PATENT DOCUMENTS 5148537 6/1993 Japan .

5177544 7/1993 Japan .

*Primary Examiner*—Sikyin Ip

*Attorney, Agent, or Firm*—Max Fogiel

[57] ABSTRACT

A method of manufacturing helical springs from steel wire. The springs' skin is thermomechanically hardened by shot peening the unstressed springs followed by thermally destressing them, and shot peening them again. The second shot peening is carried out in at least two steps. The method produces springs that are just as strong as conventional but smaller and lighter in weight. The first one of the steps is a rough shot peening with shot that is coarser than in the second one of the steps which is a fine shot peening was shot at a lower speed than in the first step. This increases compression of the wire's surface and polishes the wire's surface.

6 Claims, 3 Drawing Sheets

METHOD FOR PRODUCING HELICAL SPRINGS

BACKGROUND OF THE INVENTION

The present invention concerns a method of manufacturing helical springs from steel wire, whereby the springs' skin is thermomechanically hardened Helical springs of this genus are employed especially in suspensions in the automotive industry, where they must be able to support heavy loads.

Essentially, two basic methods of manufacturing helical springs from steel wire are known—winding and coiling.

Winding begins with already heat-treated steel wire,

Coiling uses untreated wire, which is heated, coiled hot, and finally heat-treated. Coiling is described for instance in Warmgeformte Federn, 52nd International Automobile Exposition (IAA), Frankfurt-am-Main, 1987.

Less known is a third method, whereby the untreated starting material is wound cold, and the spring subjected to heat treatment in a subsequent step.

In coiling, the steel rod is treated by heating, cooling, and annealing. It is usually heated while traveling through furnaces heated by gas or oil. The steel is heated fairly gradually to austeniting temperature and allowed to harden after coiling.

Once hardened and annealed,the springs are preferably air-cooled and then hot set. "Hot setting" in the present context means stressing them at high temperature beyond their flow threshold. It is intended to establish enough inherent stress in the wire to contribute to the springs' static and dynamic load resistance and to improve relaxation and reduce creep.

The hot-set springs are then shot peened to strengthen the wire skin and provide inherent compression. Inherent compression is a particularly effective way of increasing the springs' dynamic strength in that it counteracts any high tensions that may occur at the surface of the wire while the spring is subject to load.

German 3 633 058 C1 suggests improving the steel's mechanical properties by "thermomechanical treatment" of the wire. Thermomechanical treatment differs from the conventional treatment comprising hardening and annealing by the additional step of heating to austeniting temperature followed by plastic deformation of the steel by twisting and/or rolling it.

Also known, from German 4 330 832 C2 is a method of manufacturing helical compression springs that involves shot peening the springs twice.

Eckehard Müller, finally, points out, in "Spannungsstrahlen von Schraubendruckfedern", Draht, 1, 2 (1994), that springs shot peened twice, first stressed and then unstressed, are as good as, but require less material and weigh less, than springs that have not been shot peened at all.

Although the known methods of manufacturing helical springs have been proven, they are not up to producing springs in accordance with the ever stricter demands of the automotive industry in particular for smaller springs that will weigh less and take up less space.

SUMMARY OF THE INVENTION

The object of the present invention is accordingly a method of the aforesaid genus that will result in just as strong but smaller and lighter springs.

This object is attained in accordance with the present invention in a method of the aforesaid genus in that the operating steps of an unstressed first shot peening, followed by a thermal destressing and a subsequent second shot peening, are carried out.

The first shot peening, wherein the springs' skin is hardened, plasticly deforms the wire's surface material as deep as possible. The subsequent thermal relaxation of the springs produces beneficial changes in the deformed material. These changes can be ascribed to precipitation, aging, polygonization of the crystalline structure, and the formation of a practical displacement structure.

The second shot peening, which can be carried out with the springs stressed or unstressed, produces a high inherent compression in the spring. The second shot peening is carried out in accordance with the present invention in two steps. The first step is "rough" peening and consists of high-energy bombardment with "coarser" shot. The effects penetrate deeply into the springs' skin.

The second stage is preferably carried out with either coarser or finer shot and at a lower speed. This "fine" peening increases the inherent compression at the wire's surface and polishes it.

Increasing the inherent compression at the immediate surface of the wire prevents any premature cracking at that level that might result from high dynamic loads on the loaded springs.

Polishing the surface of the wire, finally, not only decreases any notching that might derive from its structure but also primes the springs very effectively for enameling.

BRIEF DESCRIPTION OF THE DRAWINGS

The present invention will now be specified with reference to the accompanying drawing wherein.

DESCRIPTION OF THE PREFERRED EMBODIMENTS

The incoming wire is first heated to austeniting temperature in an unillustrated electric-induction furnace. The austenited wire is then plasticly deformed mechanically by rolling or twisting. It is then coiled into springs while still hot. The thermomechanical treatment of the wire is then continued by hardening and terminates with annealing.

The annealed helical springs are then rapidly cooled with water.

The purpose of the subsequent preliminary shot peening of the unstressed springs is primarily to plasticly deform the surface of the wire as deep as possible. Subsequent to the first shot peening, the springs are heated to heat-setting temperature in the same unillustrated furnace and simultaneously thermally destressed. Heat setting will occur automatically at that temperature. Once the springs have been water-cooled, they are shot peened again under stress.

The purpose of shot peening the stressed springs is primarily to generate directionally oriented high inherent compression in the wire's skin. If the springs are subjected while being shot peened to a load paralleling the load they will be subjected to in later operation, that is, especially high inherent compressions will occur along the surface of the wire in the direction that the operating load will produce the highest tension along. This is generally at 45° to the axis of the wire. The resulting inherent compressions will counteract the tension occasioned by the load in actual operation.

Figure 1:
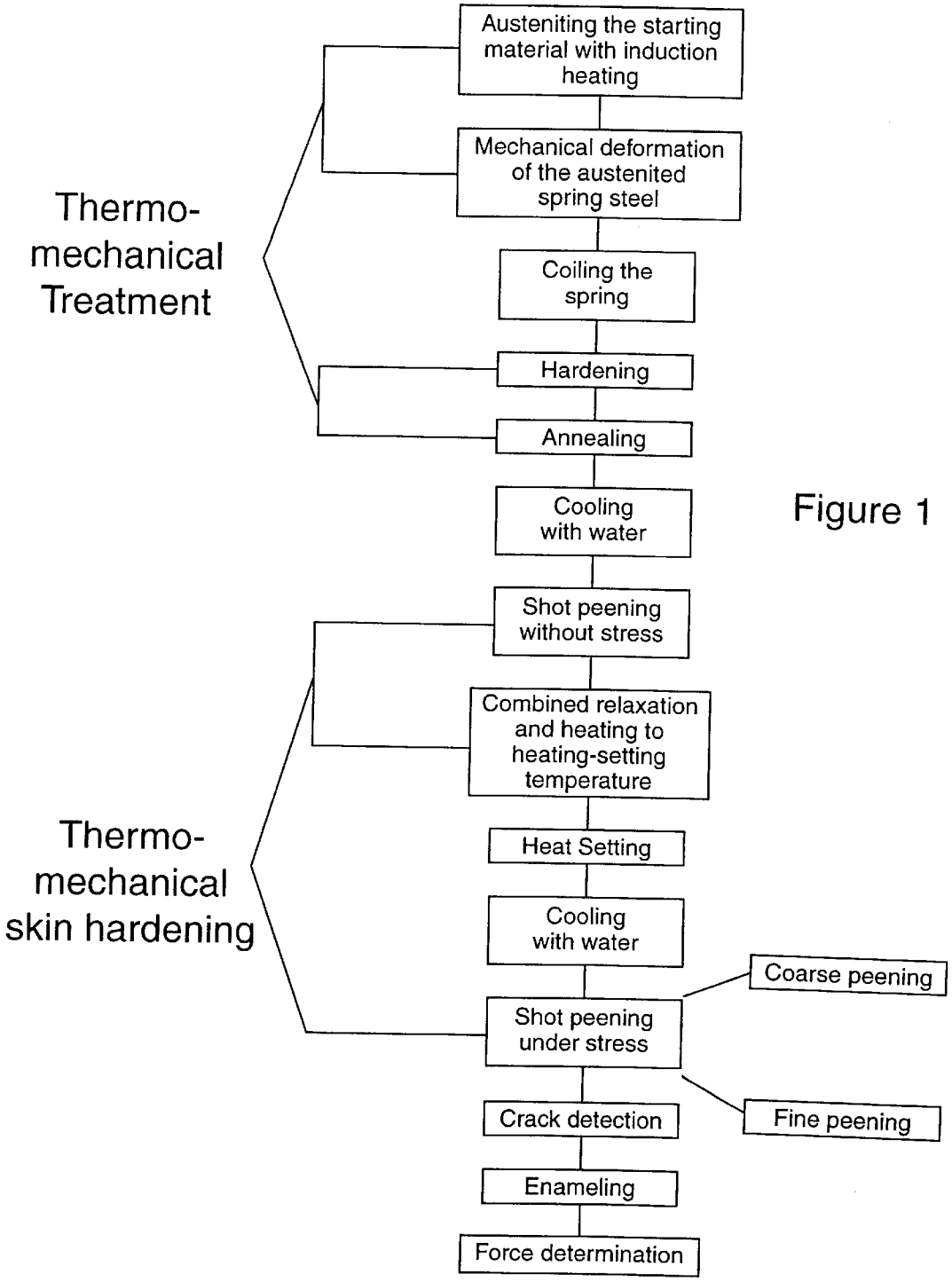
FIG. 1 is a flowchart illustrates the steps involved in the manufacture of high-strength and maximum-strength by thermomechanical treatment and thermomechanical skin hardening.
Figure 2:
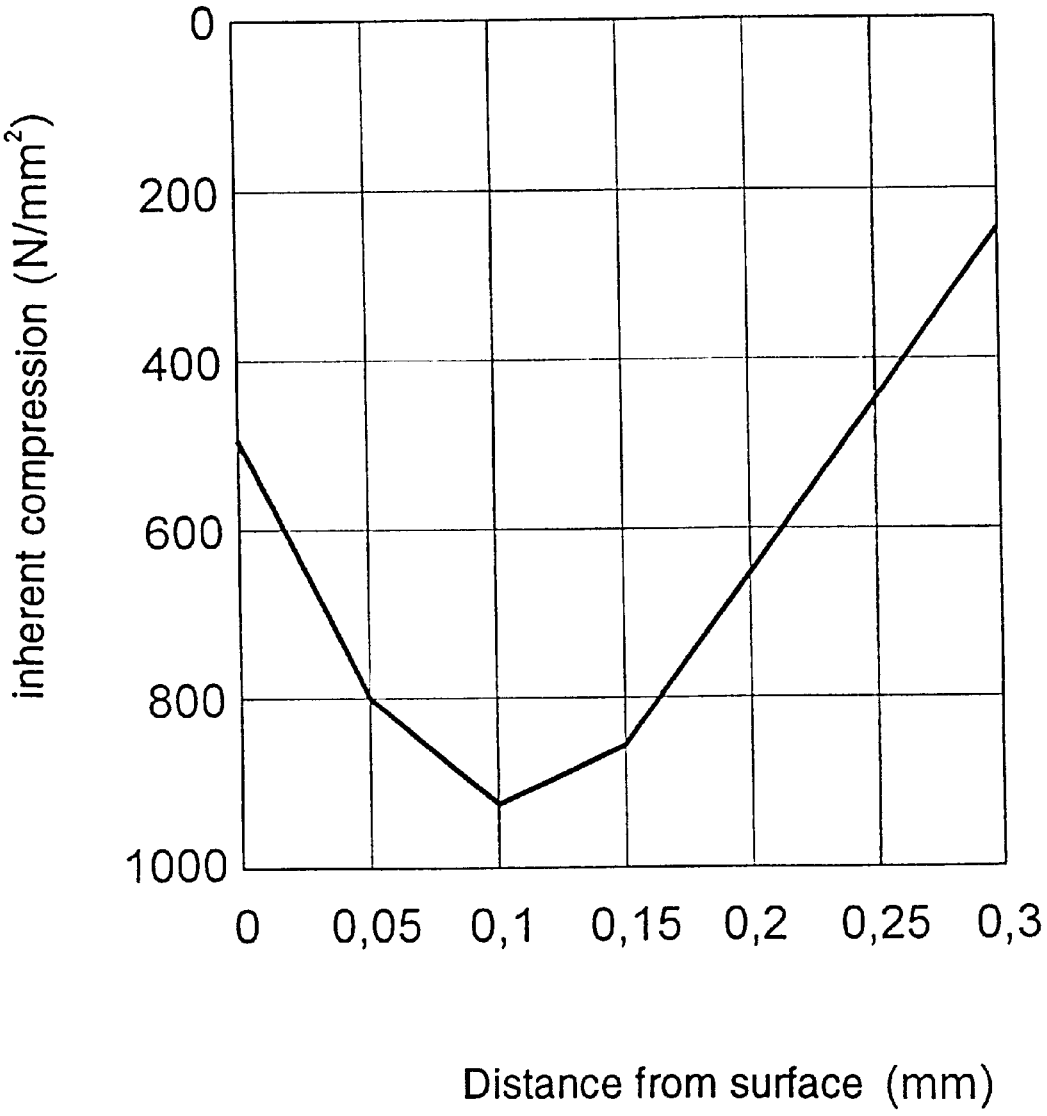
FIG. 2 is a graph of inherent compression in the springs' skin subject to shot peening under stress with coarser shot at high speed.

Shot peening under stress is carried out in two steps in accordance with the present invention. The first step involves bombardment with a relatively coarser shot, with a diameter of 0.7 to 0.9 mm. The result is the inherent compression in the skin of the wire illustrated in FIG. 2. Characteristic here is the depth that the compression penetrates to. The compression, furthermore, does not attain its maximum in the immediate vicinity of the wire's surface but only at a particular distance below it.

Figure 3:
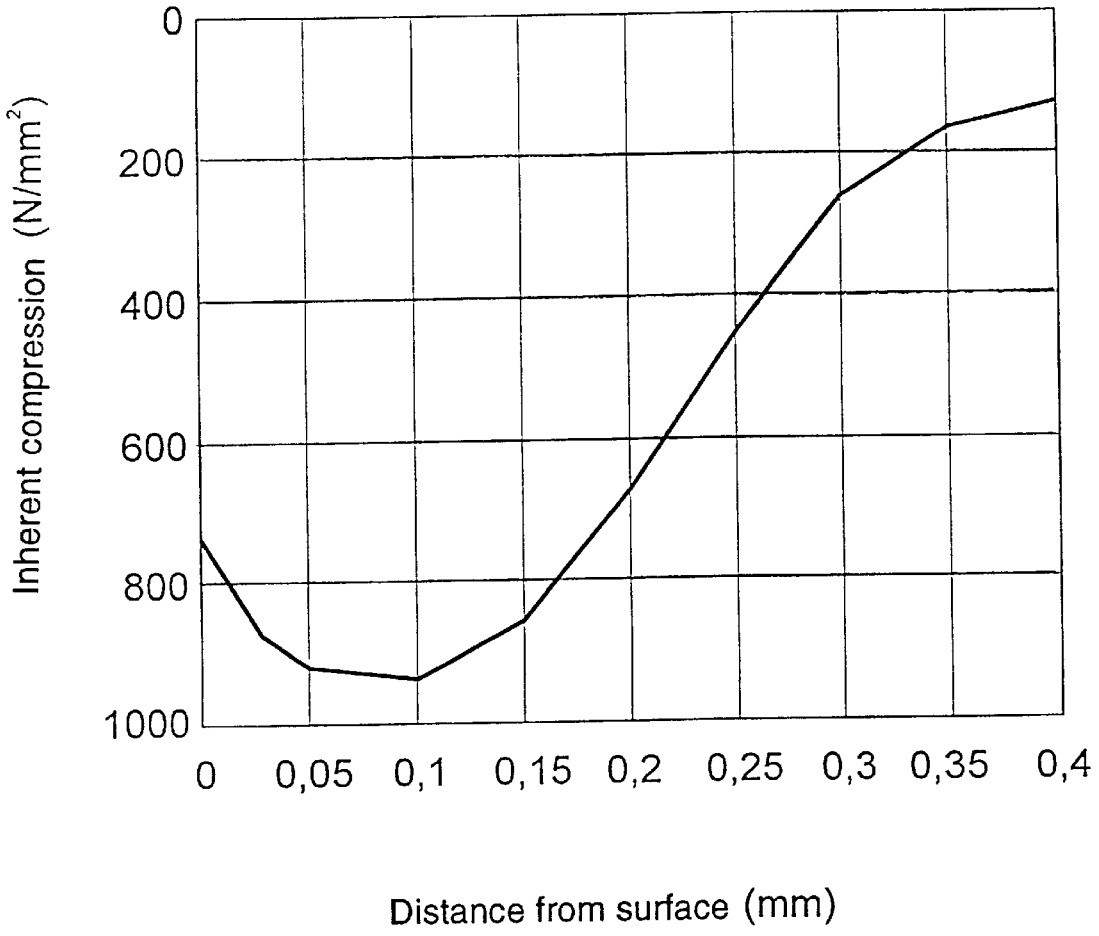
FIG. 3 is a graph of inherent compression in the skin as the result of shot peening under stress with coarser shot in one step followed by finer shot in a second step.

The second shot-peening step employs the same shot applied at a lower speed. As will be evident from FIG. 3, fine peening definitely increases the inherent compression directly at the surface of the wire and in the adjacent zones. The result is a considerable increase in the dynamic strength of helical springs manufactured in accordance with the present invention, which will be much more appropriate for use in vehicle suspensions than springs manufactured by known methods.

Manufacture is followed by crack detection, by enameling, and by determining the force of the spring. Enameling in the form of zinc-phosphating and powder coating has turned out to be especially effective against corrosion.

We claim:

1. A method of producing helical springs from steel wire comprising the steps of: hardening a spring's surface thermomechanically by a first shot peening of the surface of the spring when spring is unstressed; destressing said spring thermally after said first shot peening; applying a second shot peening to said spring, said second shot peening being carried out in at least two steps; said first shot peening hardening the spring's skin and deforming plasticly the spring's surface material to a specific depth, said step of destressing the spring thermally producing precipitation, aging, polygonization of crystalline structure in the deformed material of the spring; said second shot peening producing a substantial compression in the spring, said two steps of said second shot peening comprising a first step of rough peening with high-energy bombardment of shot penetrating substantially deeply the spring's skin a second one of said two steps comprising a fine peening at a lower speed than in said first step for increasing compression of the spring's surface and polishing the surface to prevent premature cracking of the spring's surface from substantial loads on the spring, said polishing decreasing notching of the spring and priming the spring for enameling; said first and second shot peening gerating substantially directionally oriented compression in said spring's surface, substantial compression occurring at a specific distance below said spring's surface in a direction along which an operating load will produce maximum tension when said spring is subjected to a load parallel to a load to be applied in a subsequent operation, said compressions counteracting any tension induced by a load during operation; whereby said spring is subjected to three shot peenings.

2. A method as defined in claim 1, wherein said second shot peening is applied to said spring when stressed.

3. A method as defined in claim 1, wherein said spring is bombarded during the second step of said second shot peening with shot having substantially the same size as the shot bombarding said spring in the first step, said shot during said second step having a lower speed than said shot during said first step.

4. A method as defined in claim 1, wherein said spring is bombarded with a first shot of shot peening during the first step and with a second shot of shot peening during the second step, said first shot of shot peening in said first step being larger than said second shot of shot peening.

5. A method of producing helical springs from steel wire comprising the steps of: hardening a spring's surface thermomechanically by a first shot peening of the surface of the spring when spring is unstressed; destressing said spring thermally after said first shot peening; applying a second shot peening to said spring, said second shot peening being carried out in at least two steps, a first one of said steps comprising a rough shot peening with shot coarser than in a second one of said steps, said second one of said steps comprising a fine shot peening with shot at a lower speed than in said first one of said steps for increasing compression of the wire's surface and polishing the wire's surface; said first shot peening hardening the spring's skin and deforming plasticly the spring's surface material to a specific depth, said step of destressing the spring thermally producing precipitation, aging, polygonlzation of crystalline structure in the deformed material of the spring; said second shot peening producing a substantial compression in the spring, said two steps of said second shot peening comprising a first step of rough peening with high-energy bombardment of shot penetrating substantially deeply the spring's skin a second one of said two steps comprising a fine peening at a lower speed than in said first step for increasing compression of the spring's surface and polishing the surface to prevent premature cracking of the spring's surface from substantial loads on the spring, said polishing decreasing notching of the spring and priming the spring for enameling; said first and second shot peening gerating substantially directionally oriented compression in said spring's surface, substantial compression occurring at a specific distance below said spring's surface in a direction along which an operating load will produce maximum tension when said spring is subjected to a load parallel to a load to be applied in a subsequent operation, said compressions counteracting any tension induced by a load during operation; whereby said spring is subjected to three shot peenings.

6. A method of producing helical springs from steel wire comprising the steps of: hardening a spring's surface thermomechanically by a first shot peening of the surface of the spring when spring is unstressed; destressing said spring thermally after said first shot peening; applying a second shot peening to said spring, said second shot peening being carried out in at least two steps, a first one of said steps comprising a rough shot peening with shot coarser than in a second one of said steps, said second one of said steps comprising a fine shot peening with shot at a lower speed than in said first one of said steps for increasing compression of the wire's surface and polishing the wire's surface, said increasing of compression preventing premature cracking resulting from dynamic loads on said springs when loaded, said polishing reducing notching due to structure of said springs and priming said springs for enameling, said spring being bombarded during the second step of said second shot peening with shot having substantially the same size as the shot bombarding said spring in the first step, said shot during said second step having a lower speed than said shot during said first step; said spring being bombarded with the first shot of shot peening during the first step and with the second shot of shot peening during the second step, said first shot of shot peening in said first step being larger than said second shot of shot peening; said first shot peening hardening the spring's skin and deforming plasticly the spring's surface material to a specific depth, said step of destressing the spring thermally producing precipitation, aging, polygonization of crystalline structure in the deformed material of the spring; said second shot peening producing a substantial compression in the spring, said two steps of said second shot peening comprising a first step of rough peening with high-energy bombardment of shot penetrating substantially deeply the spring's skin a second one of said two steps comprising a fine peening at a lower speed than in said first step for increasing compression of the spring's surface and polishing the surface to prevent premature cracking of the spring's surface from substantial loads on the spring, said polishing decreasing notching of the spring and priming the spring for enameling; said first and second shot peening gerating substantially directionally oriented compression in said spring's surface, substantial compression occurring at a specific distance below said spring's surface in a direction along which an operating load will produce maximum tension when said spring is subjected to a load parallel to a load to be applied in a subsequent operation, said compressions counteracting any tension induced by a load during operation; whereby said spring is subjected to three shot peenings.

* * * * *